US005233973A

United States Patent [19]

Gill et al.

[11] Patent Number: 5,233,973

[45] Date of Patent: Aug. 10, 1993

[54] SUPPORT STRUCTURE FOR HUMANS AND MASSAGING MECHANISM THEREFOR

[75] Inventors: Prem P. Gill, Rochester Hills; William W. Dinnan, Stanwood; Mark D. Nicholas, Clarkston, all of Mich.

[73] Assignee: General Motors Corporation, Detroit, Mich.

[21] Appl. No.: 855,957

[22] Filed: Mar. 23, 1992

[51] Int. Cl.[5] ..... A61H 1/00

[52] U.S. Cl. ..... 128/33; 128/52; 128/57

[58] Field of Search ..... 128/33, 36, 57, 58, 128/60, 34, 35, 51, 52; 297/284.1, 284.11, 298

[56] References Cited

U.S. PATENT DOCUMENTS

| | | | |
|---|---|---|---|
| 4,422,448 | 12/1983 | Sugai et al. | 128/44 |
| 4,422,449 | 12/1983 | Hamabe | 128/57 |
| 4,574,786 | 3/1986 | Hashimoto | 128/57 |
| 4,686,967 | 8/1987 | Hashimoto et al. | 128/57 |
| 4,718,408 | 1/1988 | Berreiro | 128/57 |
| 4,915,448 | 5/1990 | Morgenstern | 128/52 |

*Primary Examiner*—Robert A. Hafer

*Assistant Examiner*—David J. Kenealy

*Attorney, Agent, or Firm*—William A. Schuetz

[57] ABSTRACT

Mechanical massaging device incorporated in the back rest of a seat or other supporting equipment that has a pair of cross shafts operatively mounting paired rolling massaging wheels that can be selectively positioned and rotated to produce massaging through suspension fabric on the body of a person supported thereon. The massaging device has three centralized input shafts extending longitudinally within the confines of a cavity in the back rest or other support which are selectively driven by user controlled motors remote from the massaging wheels. The lateral spacing of the massaging wheels as well as their rotation can be adjusted. The massaging wheels can be selectively positioned at an infinitely number of vertical positions within the cavity to provide massaging action for enhancing the supply of blood to supported body areas under pressure of body weight. The device includes a mechanism for varying massage pressure and the massaging wheels and associated components can be moved to an out of way position when inactivated. A thigh massaging unit in a seat is also disclosed.

10 Claims, 5 Drawing Sheets

210
M
50
52
162
156
158
176
163
160
49
204
172

SUPPORT STRUCTURE FOR HUMANS AND MASSAGING MECHANISM THEREFOR

TECHNICAL FIELD

This Invention relates to support structure for the human body and massaging mechanism associated therewith to impart kneading and massaging action to selected localized or general areas of the body to stimulate the blood supply to the muscles under pressure of body weight to thereby relieve body cramps, soreness and fatigue that may occur while the support is occupied.

BACKGROUND OF THE INVENTION

Massaging machines as installed in chairs and other furnishings for massaging parts of the human body resting thereon which utilize massaging wheels are disclosed in U.S. Pat. Nos. 4,422,448; and 4,574,786 and 4,686,967.

The present invention is of the general category of the above identified patent disclosures but features compact and light weight construction with improved massaging action particularly suitable for installation within furnishing having strict space and weight limitations.

SUMMARY OF THE INVENTION

The preferred embodiment of this invention basically incorporates a pair of rotating massaging wheels operatively mounted within the back rest of a chair, a bed or other equipment supporting a human which are selectively rotatable on a compound angle and selectively positioned at any of an infinite number of positions apart from one another and positioned at an infinite number of positions along a longitudinal axis to act through resilient suspension fabric of elastomeric material to massage the occupant of the support. This construction has clustered drive motors remote from the drive wheels and is compact and light weight and fits within a cavity such as within a back rest of a vehicle seat without intrusion into the passenger compartment of a vehicle, and stows automatically on command in an out-of-the-way position and meets all automotive standards The massaging wheels are cambered and eccentrically mounted on a drive shaft, and when rotatably driven, simulate the massaging action of the hands of a masseur with rolling and increasing pressure to maximum pressure and subsequently providing a controlled release of this pressure. Preferably, the wheels act through a resilient suspension fabric providing the primary support for the back and then through a thin layer of foam for comfort. The suspension fabric may provide some spreading of the pressure of the massaging wheels, but more importantly, supports the users back and protects the foam cushion of the back rest or other support component so that there is little or no wear of the foam.

The massaging mechanism has "floating" or natural adjustment motion within the confines of the cavity in the back rest, or other support, so that the massaging rollers follow the curvature of cooperating side tracks which generally traces the curvature of the human spine and will not protrude into the user's back or body. However, pressure adjustment is provided so that the amount of massaging pressure can be selected.

Importantly, the massaging mechanism can be stowed in an out-of-way position within the seat back for comfort and safety improvements. A control panel convenient to the occupant controls electrical circuitry in a module to allow the occupant to select the different actions of the massaging mechanism of this invention. Also included is a mechanism for massaging the thigh areas of an occupant seated in the chair.

These and other objects, features and advantages will become more apparent from the following detailed description and drawings in which:

DESCRIPTION OF THE PREFERRED EMBODIMENTS

Figure 1:
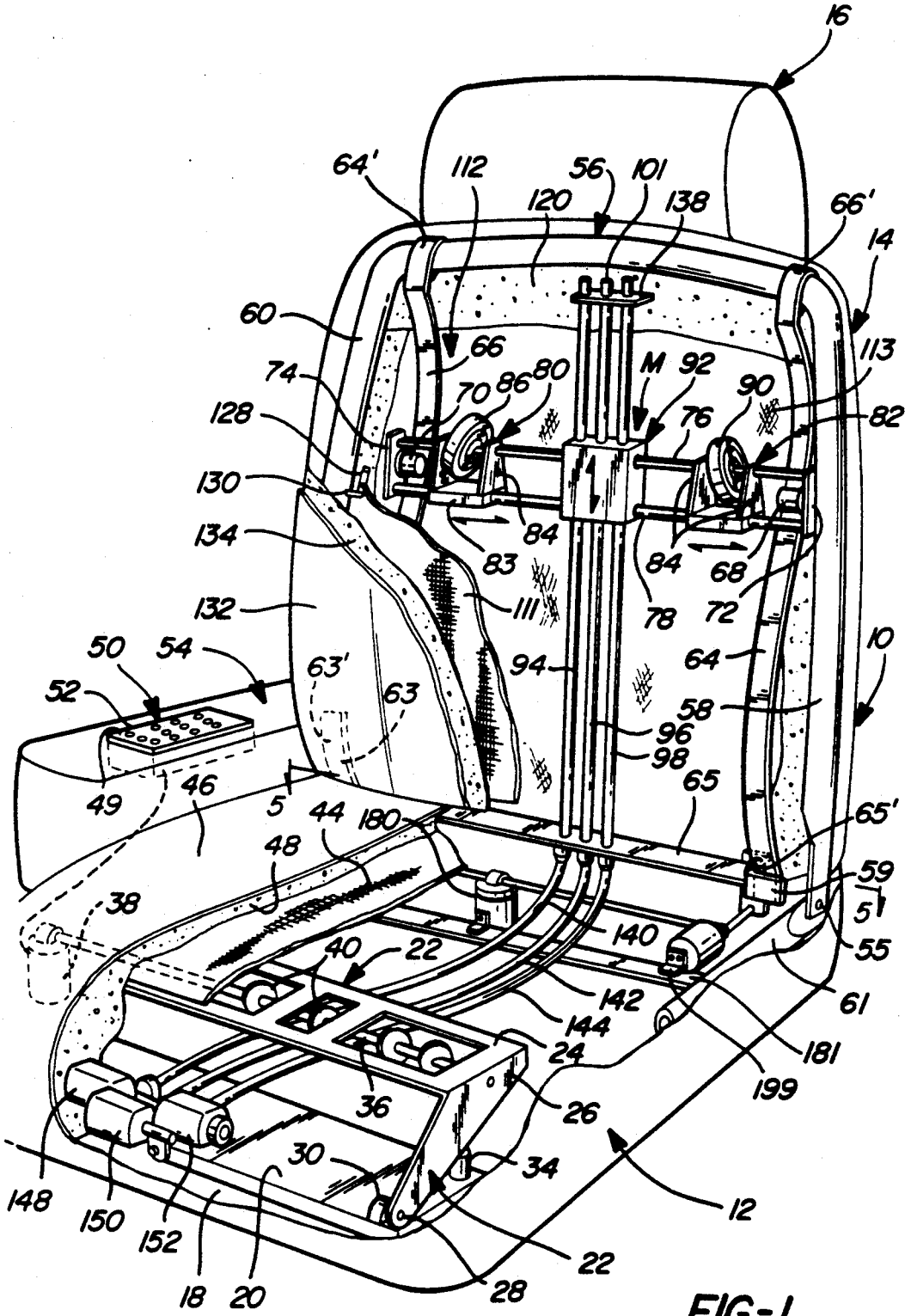
FIG. 1 is a pictorial view of a seat assembly and arm rest for a vehicle with parts broken away illustrating a preferred embodiment of this invention.

Turning now in greater detail to the drawings, there is shown in FIG. 1 a seat 10 designed to be used in an automotive vehicle for the vehicle operator or passenger that has a bottom 12, an angularly adjustable back rest 14 and a head rest 16. The bottom 12 of the seat has a conventional frame partially shown at 18 to which a base plate 20 of a thigh massaging mechanism 22 is secured.

The thigh massaging mechanism includes a support bracket having a windowed rectilinear cross member 24 that extends across the width of the cushioned bottom 12 of the seat. The cross member has support arms 26 at the opposite extremities thereof that extend in a downward and forward direction into pivotal attachment to the base plate 20 by pivots 28 journaled into blocks 30 welded or otherwise secured to the base plate. Suitable springs 34 of elastomer or other suitable material contact the lower edges of the arms 26 to provide a cushioned support to hold the thigh massage support bracket in a position in which the cross member is in a general horizontal position extending across the front of the bottom of the seat.

A laterally extending rotatable shaft 36 is operatively mounted to the arms of the support bracket and is adapted to be driven by electric motor 38. When driven, shaft 36 rotatably drives a plurality of canted rollers 40 of any suitable configuration operatively mounted off center on the shaft 36 for applying a massaging action on the thighs of the human occupant of the seat.

In the preferred configuration, a resilient suspension sheet or mat 44 of woven polyester elastomer material is stretched across the bottom of the seat and is hooked or otherwise attached to the frame of the bottom of the seat. A seat cover 46 of leather or any suitable material is installed over a relatively thin layer of foam cushioning material 48 disposed between the suspension mat 44 and the cover. Thigh massage is readily available by selectively energizing the drive motor 38 under control by the user through a control switch 49 in a control pad 50 of a control module 52 containing the electrical control circuitry for the thigh massager. This module is operatively mounted in an arm rest 54 adjacent to the chair 10. This control switch, when selectively moved to a closed position, energizes the motor 38 which turns the shaft and the massage rollers 40 mounted thereon to effect the desired rolling and massaging action through the suspension mat, cushioning material, and seat cover to the thigh areas of the seat occupant to alleviate soreness or tightness of the muscles associated with being in a seated position for extended time periods.

As illustrated in FIG. 1, the back rest 14 has a tubular, arch-like main support frame 56 which has a pair laterally spaced side frame bars 58 and 60 that extend from the top bar of the frame into a flattened ends which may be secured to the ends of a side support frame 61 of the bottom 12 of the seat by pivots 55 for the selective inclination of the back rest by any suitable back rest adjustment mechanism not shown.

Figure 2:
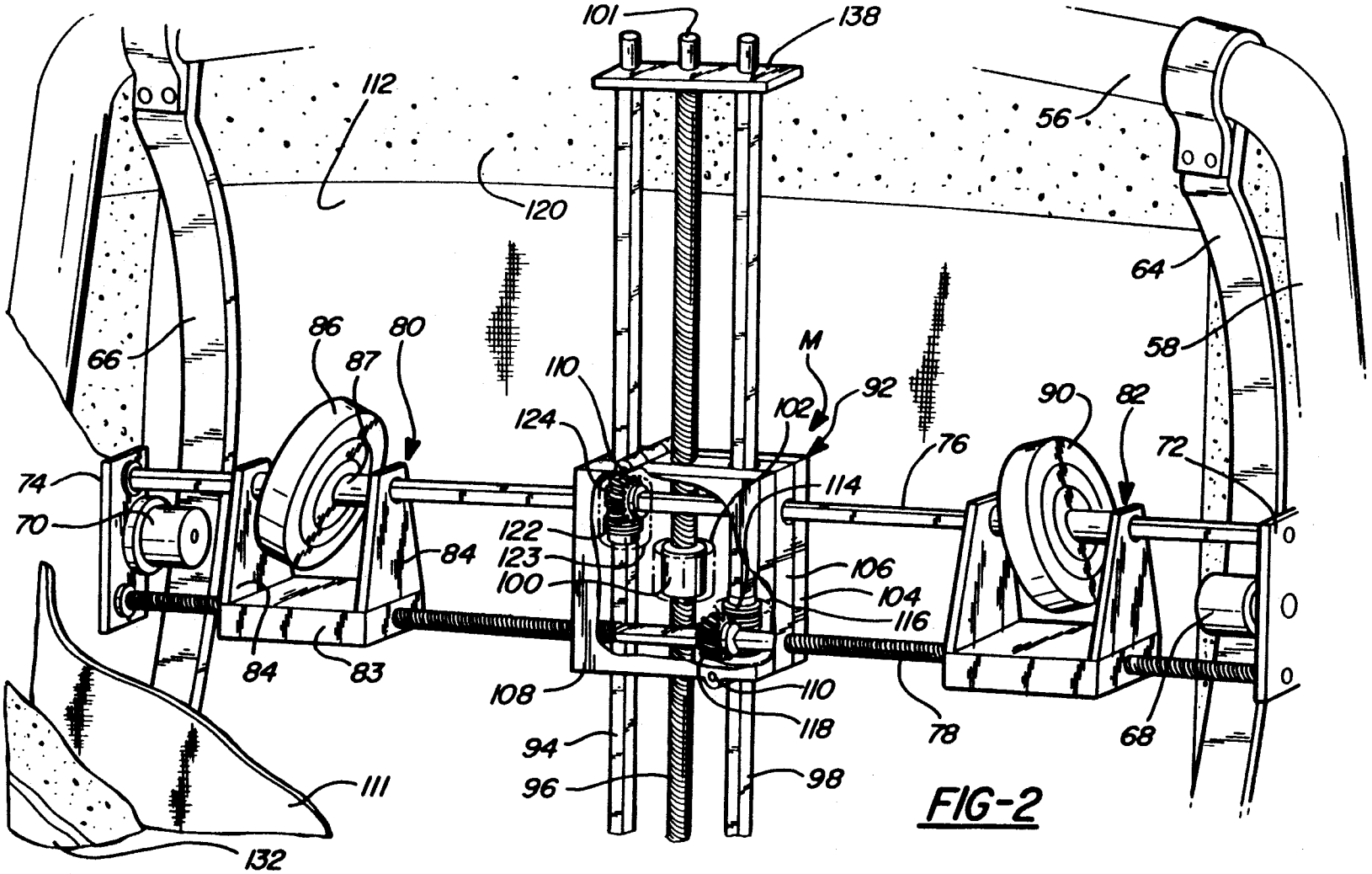
FIG. 2 is an enlarged view of a portion of the back rest of the seat assembly of FIG. 1.

A pair of laterally spaced, vertically extending and adjustable guide tracks 64 and 66, curved to conform to the curvature of the human back are top looped at 66', 64', respectively, to the upper bar of the support frame 56, as shown in the FIGS. 1 and 2 for limited turning movement thereon. The lower ends of these tracks are affixed by welds or threaded fasteners to laterally spaced brackets 59 and 63. A laterally extending rocker bar 65 is mounted by pivots at its ends to the brackets 59 and 63 to form part of a mechanism to adjust massage pressure.

The curved tracks 64 and 66, are adjacent to the generally vertical left and right side bars of the tubular frame 56, and provide undulating supports for left and right side rollers 68 and 70 operatively mounted on roller support brackets 72 and 74. The massage wheel support, and drive shaft 76 and the massage wheel adjustment screw shaft 78 laterally extend between these brackets. The left side of the adjustment screw 78 has left hand threads, while the right hand has right hand threads on which left and right hand massage wheel cages 80 and 82, respectively, are threadedly mounted for the adjustable lateral spacing of these cages.

Cages 80 and 82 are basically the same in construction so only the structure of cage 80 is described in detail. Cage 80 has a rectangular block-type base 83 which is threaded to receive the threads of the adjustment screw shaft 78 so that the screw shaft, when turned, will move the cage 80. Cage 82 has right hand lead threaded on shaft 78 so the cages move toward, or away, with respect to one another depending on the direction of screw shaft rotation.

Extending upwardly from the base 83 are a pair of laterally spaced arms 84 which slidably fit with rotational clearance on the rectilinear massage wheel support and drive shaft 76. These arms are located on either side of the massage wheel 86 which is mounted in a canted and off center manner on a hub which has a rectilinear opening therethrough so that the massage wheel rotates with the shaft 76 and can linearly slide therealong. These arms, accordingly, provide support for the cage and prevent the cage from rotating when the screw shaft 78 is being rotated so that the carriages and their massage wheels will be traversed laterally in response to rotation of the screw shaft.

In the preferred embodiment, the massage wheel 86, and its corresponding massage wheel 90 of cage 82, can be rotatably driven when the massage wheel shaft 76 is rotatably driven. The massage wheels being mounted off center with respect to the rotational axis of shaft 76 and being canted, or cambered, rotate on compound angles when driven by shaft 76 to produce a massaging effect on the back of the occupant of the seat. Accordingly, when the wheels 86 and 90 are rotatably driven from a start position, they will exert pressure on the back which will gradually increase as the wheels rotate through a predetermined angle, 270° for example, and then progressively decreased to zero during the remaining 90° of each turn to simulate the massaging actions of the hands of a masseur.

The laterally extending screw shaft and the massage wheel drive shaft extend through a carrier assembly 92 which is mounted for up and down movement on three vertically extending drive shafts 94, 96 and 98. The central vertical shaft 96 is an adjustment screw shaft which threads through a cylindrical adjustment nut 100 to a terminal free end 101.

Figure 3:
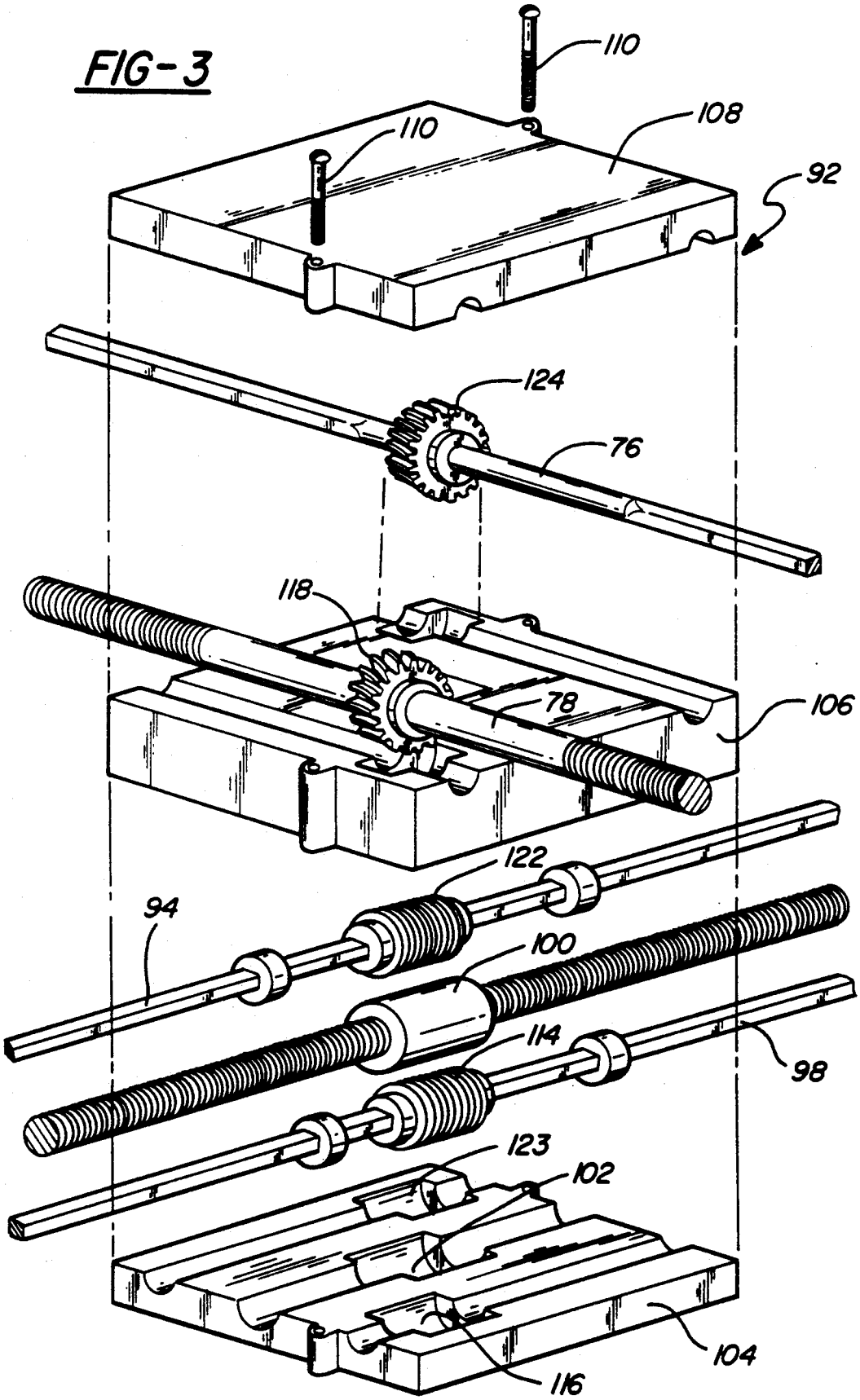
FIG. 3 is an exploded view of a carrier assembly and drive shafts associated therewith of the preferred embodiment of FIGS. 1 and 2.

The nut 100 is trapped in a cylindrical cell 102 in the carrier assembly 92. The carrier assembly has three block-like components 104, 106 and 108 stacked and held together by threaded fasteners 110, shown in FIG. 2 and 3. Rotation of the shaft 96 will effect the vertical movement of the carrier assembly 92 as well as the massaging wheels 86 and 90 and their mounting components, which cooperate with tracks 64 and a forward suspension mat 111 of resilient material. The carrier assembly, the wheels and drive shafts comprise a massaging unit M. When conventionally seated, the force of the occupant's back acting through the fabric of the suspension mat 111 acts on the mechanism to readily urge the rollers 68 and 70 against the tracks since the ends of shaft 96 and adjacent vertical drive shaft 94 and 98 are free. With this construction, the shafts 94, 96, 98 can have limited pivotal movement as provided by rocker bar 65 within the cavity 112, generally defined, between the back cover 113 of the back rest and the forward suspension mat.

The second vertically extending drive shaft 98 turns a worm 114 slidable on the shaft but trapped in a cell 116 formed in the block of the carrier assembly 92. The form 114 drives a worm wheel 118 which turns the threaded massage wheel adjustment screw shaft 78 to provide for the horizontal adjustment of the cages 80 and 82 and the massage wheels associated therewith.

Accordingly, by rotating shaft 98, the cages 80 and 82 will be simultaneously moved toward, or away from one another, depending upon rotation of shaft 98 to move the massaging wheels closer together, or further apart, for a wide range of localized or general back massages.

The third shaft 94 extending beside the vertical adjustment screw drives the massage wheel drive shaft 76 through an associated worm 122 that is trapped in a cell 123. Worm 122 drives worm wheel 124 mounted on the shaft 76 of rectangular cross section to rotate shaft 76 and the massaging wheels 86 and 90 on their compound massaging angles.

The massaging mechanism M is operatively mounted in the generally rectangular cavity 112 provided by removing material from the foam padding 120 and bounded front and back by back cover material 113 and a suspension mat 111.

Disposed between the massaging wheels 86 and 90 and the front cover of the seat back is the suspension mat 113 preferably of a woven polyester elastomeric material that is secured by a border wire 128 and hooks 130 that attach the border wire and mat to the tubular frame 56. A cover 132 with a relatively thin layer of foam backing 134 overlays the suspension mat. The suspension mat and the thin layer of foam backing will effectively transmit the rolling forces of the massaging wheels to the area of the users back as personally selected for an effective general or localized massage that simulates a massage by hand. The suspension mat and the foam backing provides a comfortable support for the back when the massager is in use, and when moved to the stowed position.

As shown, the three vertical shafts 94, 96, 98 extend through the carrier assembly and through a top plate 138 that ties the shafts together while allowing their rotation and limited free movement within the confines of the back rest during massaging action. The lower ends of these rods extend through large opening in the rocker bar 65 and connect to three flexible drive shafts 140, 142, 144 that extend beneath the suspension mat 44 of the cushioned seat and under the thigh massage unit 22 and respectively connect to the outputs of three reversible drive motors 148, 150, 152 which are secured in a cluster on the base plate 20 of the massage unit.

In the event that a thigh massage mechanism is not desired in the seat design, these motors can be readily secured to any part of the front of the seat. The motor 148 for driving the vertical adjustment screw 96 is selectively controlled by switches 156, 162, 163 in the control pad 50. By selectively closing switches 162, 163, for example, the motor 148 will be energized for timed periods to effect turning of the adjustment screw shaft 96 so that the carrier assembly 92 with the cross shafts and massaging wheels will be moved up and down for local roll massage or full range roll massage within the confines of the back rest 14. Switch 156 can be rocked to selectively position the massaging rollers in any selected vertical position.

The motor 150 is energized by rocking switch 158 clockwise or counterclockwise for turning the flexible drive shaft 144 in selected clockwise or counterclockwise direction which drives shaft 98 for the rotation of shaft 98 moving the massage wheel cages and the massage wheels closer or further apart, as desired, so that their spacing can be widened for a wide massage or narrowed and closer to the spine of the occupant for a localized massage.

The third motor 152 energized by the closure of the kneading switch 160, and knead speed switch 162 for the selective drive of the massaging wheels. When this motor is energized, the massaging wheels will be turned to provide the orbital or elliptical motion of the massaging wheel and the effective kneading massage of the occupants' back. As indicated above, the speed of motor 148 and kneading speed is effected by rocker switch 162. When the right side is depressed, the speed of the massaging wheels is decreased, and when the left side is depressed, the speed of the massaging wheels is increased.

Kneading action can also be obtained during full and local up and down massages by closing switch 160 or 162 as desired so that the massaging wheels will be rotatably driven.

Storage of massaging unit M is provided by the closure of switch 172 of the control pad. When this switch is closed, the motors 148 and 152 are shut down while motor 150 is driven in reverse until a limit switch, or other shut off device, stops the motor and the massager is stored at the lower portion of the seat back and within the confines thereof for safety and to ensure that the seat remains as comfortable as a conventional seat.

This invention additionally provides for massage pressure adjustment by a mechanism which swings the guide tracks 64, 66 with respect to turning points provided by the ends of the tracks looped at 64', 66' around the top bar of the frame.

Figure 4:
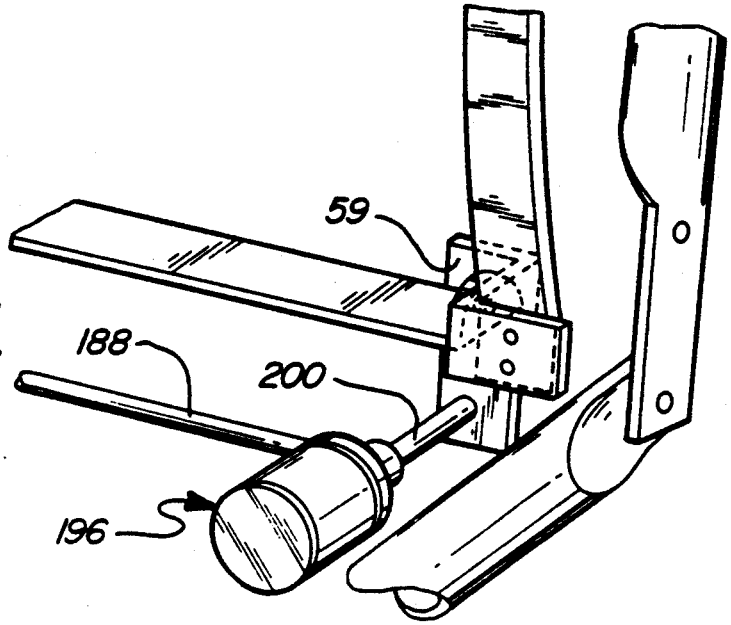
FIG. 4 is an enlarged pictorial view of a portion of FIG. 1 illustrating a mechanism for varying massage pressure of the back rest of the seat assembly.
Figure 5:
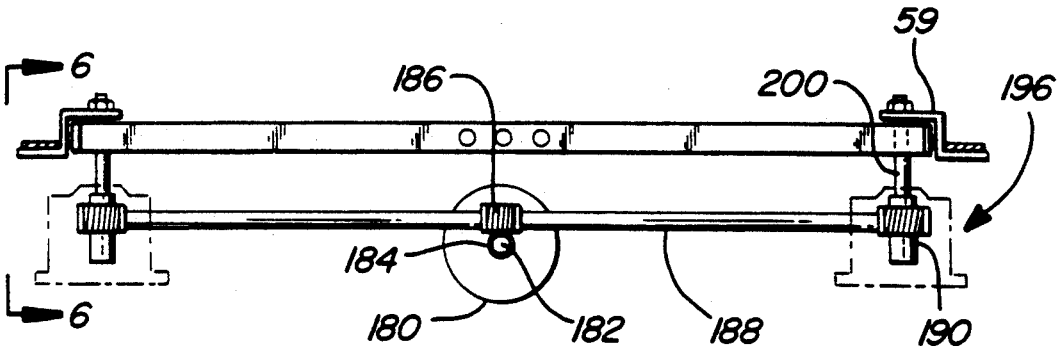
FIG. 5 is a top view with parts removed and with parts in section taken generally along sight lines 5—5 of FIG. 1.
Figure 6:
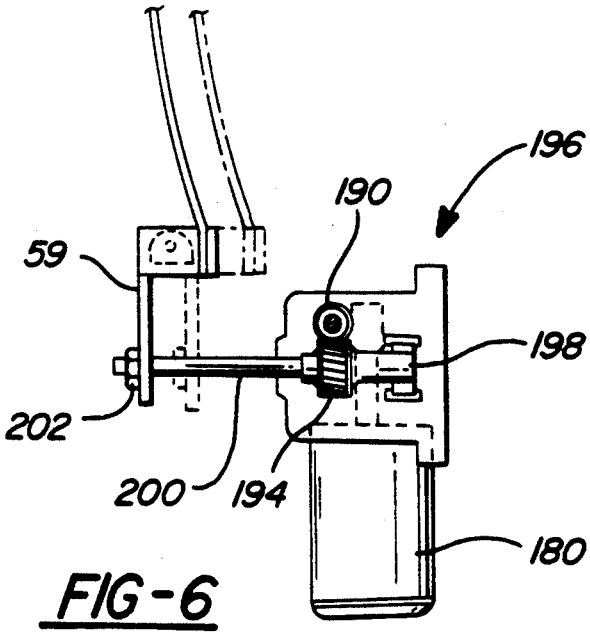
FIG. 6 is a view partly in section taken generally along sight lines 6—6 of FIG. 5.

As shown in FIG. 1, 4 and 5, a reversible drive motor 180 is secured to cross bar 181 of the frame of the seat bottom 12 and within the confines thereof. This motor has an output shaft 182 that terminates in a worm gear 184. Worm gear 184 meshes with a worm 186 fixed in a centralized position on a laterally extending drive shaft 188. The ends of this drive shaft terminal in worms 190, 192 affixed thereto which respectively mesh with worm gears, such as worm gear 194 of FIG. 6, which form the components of risers 196 fixed within the seat bottom 12. The worm gear 194 forms part of a rotatable actuator 195 operatively mounted by bearing the housing 197 of the riser. The housing is secured to a bracket 199 fixed to crossbar 181. The rotatable actuator is an internally threaded drive member 198 in which threaded output 200 is operatively mounted. The end of the output shaft 200 is secured to bracket 59 or by fastener means 202.

With this construction, the occupant of the seat can adjust the pressure exerted by the massaging rollers by energizing the motor 180 through closure of the rocker switch 204. When an increased massaging pressure is desired, the occupant will rock the switch 204 in one direction to effect the energization of motor 180 for rotation in a direction that turn the worm 186 and the attached shaft 188 in one direction. The attached worms 190, 192 drive the worm gears in a first direction so that output shafts 200 are drawn into the actuators of the risers 196. This results in the swinging movement of the tracks toward the occupant to increase massage pressure. To decrease massage pressure, the motor drive is reversed to move the tracks away from the occupant. Using these controls the contact pressure of the massaging wheels with the mat or suspension fabric 111 is increased or decreased as desired so that the massaging effect on the back is increased, or decreased.

Figures 7, 8, 9:
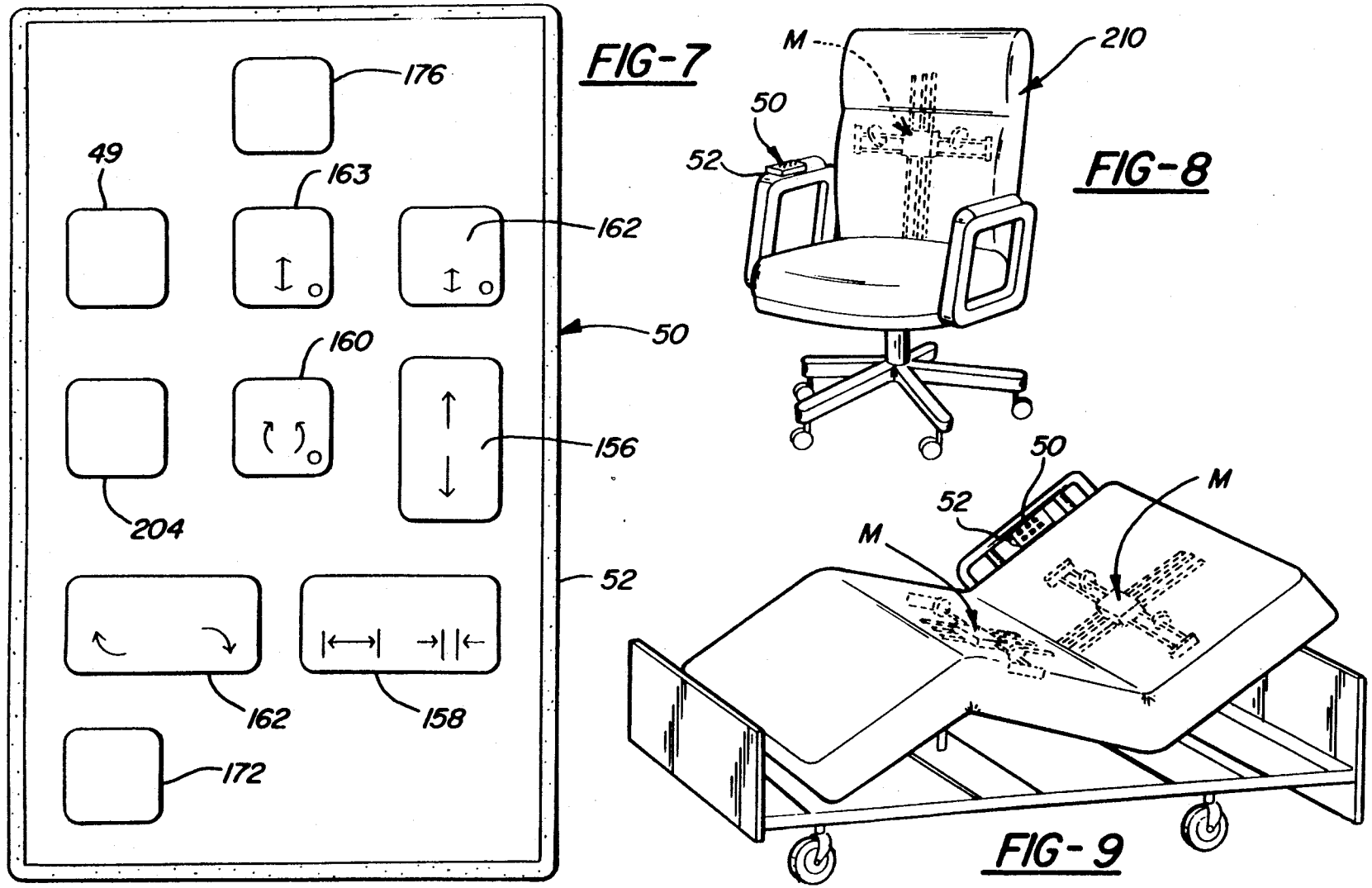
FIG. 7 is a top view of a portion of a control pad of a controller for the massaging mechanism used with the back rest of the seat assembly of FIG. 1.
FIG. 8 is a pictorial view of a chair employing the massaging mechanism of this invention.
FIG. 9 is a pictorial view with parts removed of a hospital type bed employing massaging mechanisms of this invention in portions thereof supporting the back and lower body portions of an occupant.

FIG. 8 shows the massaging unit M of this invention as employed in the back of an office chair 210. FIG. 9 shows a pair of massaging units M installed in a hospital type bed for effective massaging action to increase circulation to bed-ridden patients to prevent the decubitus, or other soreness, that might be occasioned by a bed ridden patient. In each of these supports a suspension sheet of resilient fabric material is interposed between the massaging wheels and the occupant.

While the above description constitutes preferred embodiments of the invention, it will be appreciated that the invention can be modified and be varied without departing from the scope of the accompanying claims.

The embodiments of the invention in which an exclusive property or privilege is claimed are defined as follows:

1. A support and massaging unit for selectively rubbing and kneading a part of a human body positioned thereon comprising a frame, a back cover for finishing a back side of said unit, a suspension sheet attached to said frame for supporting said part of the human body to be massaged, said suspension sheet and said back cover being spaced from one another and cooperating with said frame to define a cavity within said unit, a support bar mounted at an end portion of said unit, a plurality of drive rods extending from said support bar in a first direction within said cavity and terminating in end portions adjacent an opposite end of said unit, means for selectively driving each of said rods, a carrier operatively mounted on said drive rods for movement therealong in response to the rotational drive of one of said rods, a pair of laterally spaced cross rods operatively mounted within said carrier to extend across said drive rods and operatively connected with other second and third drive rods, a pair of cages mounted on said cross rods for movement thereon in response to the rotation of one of said cross rods, massage wheel means operatively mounted on each of said cages and associated with the other of said cross rods for rotation therewith and for rolling contact with said suspension sheet, and laterally spaced track means associated with the ends of said cross rods to support and maintain said rods and said massage wheels within said cavity of said support and massaging equipment.

2. The support and massaging unit of claim 1, and further incorporating motor means for driving said second cross rod to rotate said massaging wheel so that said massaging wheels exert an increasing pressure on said suspension sheet and on said part of said body supported thereon until a maximum pressure is exerted and to release said pressure on the continued rotation of said massaging wheels.

3. The support and massaging equipment of claim 2, and wherein said tracks are pivotally connected with said frame at one end for movement toward and from said suspension sheet, and further including actuator means connected with said tracks for pivoting said tracks within the confines of said frame to thereby move said tracks toward and from said suspension sheet to thereby control the pressure of said massaging wheels on said suspension sheet and the part of said body being supported on said sheet and experiencing the pressure of said wheels.

4. The support and massaging equipment of claim 2, and control means for moving said massaging mechanism to a position at one end of said support allowing said suspension to frame said body.

5. Support and rest unit for humans having massaging equipment for selectively rubbing and kneading a part of the human body positioned thereon comprising a frame, a back cover for said unit supported by said frame, a forward suspension sheet attached to said frame to support the weight of at least a part of the body of the human utilizing said unit, said suspension sheet and said back cover being spaced from one another and cooperating with said frame to provide a cavity within said unit, a support bar mounted at an end portion of said frame, a plurality of drive rods extending from said support bar in a first direction within said cavity and terminating in swingable free end portions within said cavity, means for selectively driving each of said rods, a carrier operatively mounted on said drive rods for movement therealong in response to the rotational drive of one of said rods, a pair of laterally spaced cross rods operatively mounted within said carrier to extend across said drive rods and operatively connected to other second and third drive rods of said drive rod means, a pair of cage units mounted on said cross rods for movement along said cross rods in response to rotation of said second of said drive rod means, massage wheel means operatively mounted on each of said cage units and on said second of said cross rods for rotation therewith and for rolling contact with said forward suspension sheet, and laterally spaced wheel and track means associated with the ends of said cross rods to support the ends of said cross rods so that said massage wheels can effectively massage the portion of said body supported by said suspension sheet.

6. The support and rest unit of claim 5, and further incorporating motor means for driving said second cross rod to rotate said massaging wheel so that said massaging wheels exert increasing pressure on said suspension sheet and on said part of said body supported thereon until a maximum pressure is exerted and to subsequently release said pressure on the continued rotation of said massaging wheels.

7. The support and rest unit of claim 5, and further including means for pivoting said tracks within said cavity for controlling the pressure of said massaging wheels on the part of said body supported by said suspension sheet.

8. A support and rest unit for humans with massaging mechanism for selectively rubbing and kneading a part of the human body positioned on said unit comprising a frame, a back cover for said unit, a suspension sheet attached to said frame for supporting the human body to be massaged, said suspension sheet and said back cover being spaced from one another and cooperating with said frame to provide a cavity within said unit, a rocking bar mounted for limited pivotal movement at an end portion of said support and rest unit, a plurality of drive rods extending from said rocking bar in a first direction within said cavity and terminating in a swingable free end portion within said cavity, means for selectively driving each of said drive rods, a carrier operatively mounted on said drive rods for movement therealong in response to the rotational drive of one of said drive rods, a pair of laterally spaced cross rods operatively mounted within said carrier to extend across said drive rods and operatively connected to the other of said drive rods, track means in said unit extending along the sides of said unit, wheel means associated with said track means to support the ends of said cross bars within said cavity, a pair of cage units mounted on said cross rods for movement along the extent thereof in response to the rotation of a second of said drive rods, massage wheel means operatively mounted by said other of said cross rods and by said cage units for lateral movement therealong and for rolling contact with said suspension sheet.

9. The support and rest unit of claim 8, and further including actuator means for pivoting said rocking bar and moving said tracks within the confines of said frame toward and from said suspension sheet to control the pressure of said massaging wheels on said suspension sheet and on the part of said body being supported on said sheet which experiences the pressure of said massage wheel means.

10. A vehicle seat for supporting an occupant of a vehicle comprising a seat cushion unit and a back rest extending upward from the seat cushion unit, said back rest having a frame and back and forward covering means defining a cavity within the back rest, a massaging mechanism supported by said vehicle seat and located primarily within said cavity so that it does not deform the back covering means and protrude into the space behind the back rest, the forward covering means including are resilient suspension sheet, rock bar means pivotally supported by said back rest frame adjacent the lower end of the back rest, drive shaft means supported by said rock bar means and which extends vertically of the back rest, a carrier supported by said drive shaft means and drivingly connected therewith for movement up and down along the back rest, a pair of massage wheels, cross shaft means carried by said carrier and extending laterally across said back rest and connected with said massage wheels for driving said wheels and for adjusting their positions laterally of said back rest, rollers supported by and located at the ends of said cross shaft means, vertically disposed curved track means extending within said back rest and along its sides thereof for receiving the rollers for said cross shafts to support the ends thereof as the massaging mechanism moves up and down within the cavity and with the wheels contacting the suspension sheets to massage the back of the occupant in the seat, said curved tracks being pivotally supported by said back rest frame adjacent its upper end, an actuator means operatively connected with the lower ends of said curved tracks for moving said curved tracks toward and from said suspension sheet of the front covering so as to vary the pressure of the massaging wheels against the back of the occupant.

* * * * *